US005827088A

United States Patent [19]

Weatherley

[11] Patent Number: 5,827,088

[45] Date of Patent: Oct. 27, 1998

[54] SOCKET MOUNTING SYSTEM

[76] Inventor: Richard Weatherley, 23 Tenter Rd., Moulton Park Industrial Estate, Northampton, NN3 1AX, United Kingdom

[21] Appl. No.: 807,879

[22] Filed: Feb. 26, 1997

[51] Int. Cl.[6] ..... H01R 13/60

[52] U.S. Cl. ..... 439/540.1; 439/532

[58] Field of Search ..... 439/540.1, 76.1, 439/532, 676, 701, 716; 361/736

[56] References Cited

U.S. PATENT DOCUMENTS 5,083,941 1/1992 Rodgers et al. ..... 439/553 X
5,460,541 10/1995 Weatherley ..... 439/532

*Primary Examiner*—Khiem Nguyen
*Attorney, Agent, or Firm*—Watson Cole Grindle Watson, P.L.L.C.

[57] ABSTRACT

A mounting system for mounting a jack socket on a mounting panel, e.g. of a patch panel system, comprises a first clip component mounted on the obverse face panel and a second clip component which is located on the reverse of the panel and is secured to the first clip component by inter-engaging latches. The jack socket is mounted on a PCB which is releasably secured to the second clip component by latches. With the jack socket so mounted the body of the jack socket prevents disengagement of the latches and accordingly prevents accidental disassembly of the components. By releasing the latches the jack socket complete with PCB can be removed and thereafter the latches can be disengaged to permit removal of the first and second clip components.

5 Claims, 1 Drawing Sheet

SOCKET MOUNTING SYSTEM

BACKGROUND OF THE INVENTION

This invention relates to a socket mounting system, and more particularly to a socket mounting system comprising one or more sockets secured to a mounting panel by a novel clip arrangement. The preferred embodiment of the present invention is particularly suitable for a jack socket assembly comprising a jack socket mounted on a printed circuit board. It is to be understood, however, that the invention is of general applicability to any socket system in which a socket component, for receiving a plug, is to be mounted on a mounting panel.

Jack socket assemblies are widely used in telecommunication and data distribution/collection systems to provide a releasable connection between a jack plug and a fixed wiring system. While existing jack socket assemblies function satisfactorily once installed, all existing jack socket assemblies are, to a greater or lesser extent, unsatisfactory in terms of the time required to mount the jack socket on the mounting panel. This problem is particularly acute when multiple jack sockets are required, for example on a patch panel system.

A commercially successful patch panel system is illustrated in U.S. Pat. No. 5,460,541. This specification illustrates a system in which a clip is used to secure a jack socket to a mounting panel. This system represents a considerable improvement over prior art systems in terms of speed of assembly. Even so, however, the system of this specification requires that the clip be secured to the mounting panel using suitable fasteners, for example nuts and bolts. This requirement for separate components adds to the assembly time and the inventory of components which must be stocked to effect assembly of jack systems.

SUMMARY OF THE INVENTION

The present invention relates to a socket mounting system which offers the advantages of the system of U.S. Pat. No. 5,460,541 and yet which removes the need for nut and bolt type fasteners to secure the socket mounting clip to the mounting panel.

According to one aspect of the present invention there is provided a socket mounting system comprising a mounting panel having an aperture therein; a first clip component having a face portion which, in use, lies on the obverse side of the mounting panel; a second clip component having a socket clip portion; a socket releasably secured to the second clip component by means of the socket clip portion, the socket having a portion which is presented to the aperture in the mounting panel for receiving a plug inserted from the obverse side of the mounting panel; and inter-engaging latches on the first and second clip components for latching the first clip component to the second clip component, the latches being mutually engageable and disengageable prior to mounting of the socket by the socket clip portion, but being locked against disengagement by the socket when the socket is mounted on the socket clip portion.

Preferably the first clip component includes a portion which extends through the aperture in the mounting panel and the inter-engaging latches are located on the reverse side of the mounting panel.

Preferably the first clip component includes retaining clips which releasably snap fit into retaining engagement with portions of the mounting panel when the first clip component is offered up to the mounting panel. The portions of the mounting panel engaged by the retaining clips can conveniently be provided by surface portions of the reverse side of the mounting panel, openings being provided for the retaining clips to pass through the mounting panel to engage such surfaces.

With the arrangement of the preferred embodiment the first clip component is initially offered up to the mounting panel and the retaining clips snap fitted into engagement with their mating surfaces on the mounting panel to retain the first clip portion in position. If necessary, the retaining clips can readily be manipulated out of engagement with the mounting panel to remove the first clip component. The retaining clips serve both to maintain the first clip component in position during subsequent assembly operations, and to provide positive registration and location of the first clip component relative to the mounting panel. Next, the second clip component is offered up to the reverse face of the mounting panel and the inter-engaging latches on the first and second clip components are snapped into engagement thereby mounting the second clip component. Preferably, the latches are provided by portions of the first clip component located on opposite sides of the aperture which snap fit into engagement with corresponding portions of the second clip component.

Next, in one embodiment of the invention a socket comprising a plug receiving portion mounted on a printed circuit board is inserted into the aperture provided by the first and second clip components from the rear of the mounting panel. The printed circuit board is snap fitted into engagement with the socket clip portion of the second clip component thereby locating the plug receiving portion of the socket to prevent the manipulation of the first and second clip components which would be necessary to disengage the inter-engaging latches. Accidental disassembly of the components is accordingly prevented. If deliberate disassembly of the components is required the socket printed circuit board is first disengaged from the socket clip portions of the second clip component and the socket is withdrawn from the rear. The inter-engaging means can now be manipulated to disengage the first and second clip components and the second clip component withdrawn from the rear. The retaining clips can then be released and the first clip component removed from the mounting panel.

In an alternative embodiment a socket is provided with mounting surfaces which are retained by the socket clip portion when the socket is mounted on the second clip component.

Preferably, the face portion of the first clip component provides indicia carrying or displaying surfaces whereby indicia providing information as to the identity or characteristics of the sockets may be provided on the first clip component.

The invention provides a rapid and secure system for mounting a socket on a mounting panel which does not depend on the use of discrete fasteners such as nuts and bolts. The system provides for particularly rapid assembly of panel systems including multiple jack sockets and yet facilitates easy disassembly of the components if this is necessary.

BRIEF DESCRIPTION OF THE DRAWINGS

The invention will be better understood from the following description of a preferred embodiment thereof, given by way of example only, reference being had to the accompanying drawing wherein.

DETAILED DESCRIPTION OF THE INVENTION

Figure 1:
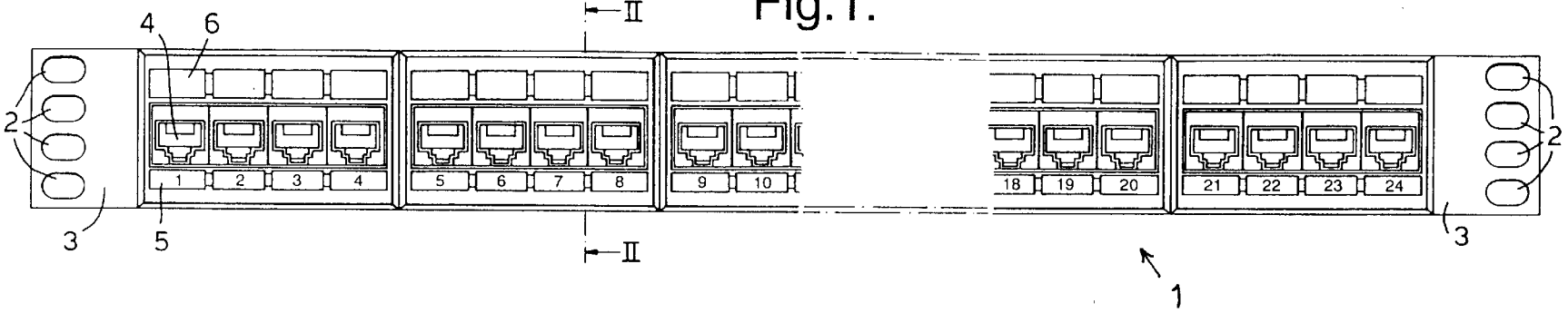
FIG. 1 illustrates schematically a typical patch panel.

Referring firstly to FIG. 1 the illustrated patch panel 1 would, in use, form part of a telecommunications or data handling system and would be mounted on the chassis of such system by way of releasable fasteners passing through apertures 2 provided in end flanges 3 of the panel. Viewed from the front, the patch panel provides twenty four jack sockets 4 each of which can receive a jack socket from the obverse face of the panel. Indicia carrying panels 5 identify by serial number the sockets and additional indicia carrying/displaying areas 6 are associated with each socket to enable additional information relating to the socket to be displayed against each socket.

Figure 2:
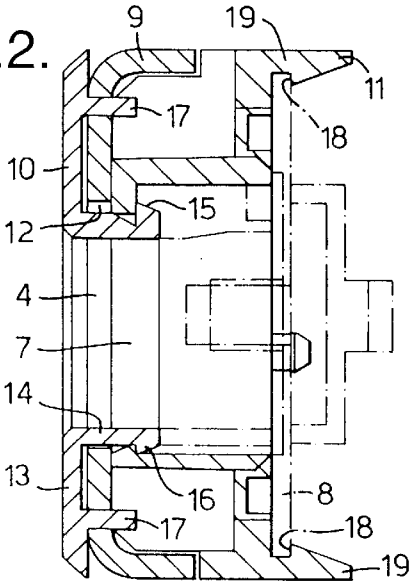
FIG. 2 is a cross-section on the line II—II of FIG. 1.

Referring now to FIG. 2, the jack sockets 4 each comprise a jack receiving portion 7 secured to and projecting from a printed circuit board 8. Each jack receiving portion 7 may have associated therewith a discrete and separate PCB 8 or a plurality of jack receiving portions 7 may be mounted on a common PCB 8. In the illustrated embodiment to the invention each PCB 8 has mounted thereon four jack receiving portions.

Each jack socket 4 is secured to a mounting panel 9 by means of a first clip component 10 and a second clip component 11. The mounting panel 9 is commonly of metal and extends the full length of the patch panel 1. The flanges 3 constitute extensions of the mounting panel and are integral therewith. Between the flanges 3 the mounting panel is generally U-shaped in transverse cross-section and has a multiplicity of apertures 12 for receiving the jack receiving portions 7. In the illustrated embodiment of the invention each aperture 12 receives a total of four jack receiving portions. It should be appreciated, however, that more or less jack receiving portions may extend through each jack receiving aperture.

The first clip portion 10 includes a face portion 13 which is located on the obverse side of the mounting panel 9. The face portion 13 provides a surface for mounting the indicia 5 and provides the surface 6 for mounting additional indicia if required. The first clip component also includes a generally tubular portion 14 which extends through the aperture 12 to form a lining for the aperture. The tubular portion 14 terminates, on the upper and lower edges thereof as viewed in FIG. 2, with latches 15,16 which inter-engage with corresponding latch surfaces provided on the second clip component 11. The second clip component 11 preferably includes other surfaces which engage the mounting panel 9 to prevent relative movement between the second clip component and the mounting panel in directions parallel to the plane of the printed circuit board 8. Thus, with the latches 15,16 engaged with the latch surfaces of the second clip component the second clip component will be positively located relative to the mounting panel.

The first clip component comprises retaining clips 17 which pass through corresponding apertures provided in the mounting panel 9 to clip the first clip component into position. In addition to assisting with assembly of the components the retaining clips 17 provide positive location of the first clip component in the plane parallel to the plane of the printed circuit board 8.

In order to assemble the various components the first clip component 10 is first presented to the obverse face of the mounting panel 9 and the retaining clips 17 are inserted through the corresponding apertures in the mounting panel to snap into engagement with the rear face of the mounting panel. By this means the first clip component is mounted on the mounting panel. The retaining clips 17 are such that, by appropriate manipulation, they can be released permitting removal of the first clip component. Next, the second clip component is offered up to the rear face of the mounting panel and pushed home so that the latches 15,16 snap into engagement with the latch surfaces provided on the second clip component 11. It will be appreciated that as the second clip component is pushed home the upper and lower (as illustrated in FIG. 2) edges of the tubular portion 14 will be cammed inwardly (towards each other) to allow the latches 15,16 to ride over the second clip component. In this context, it will be noted that the outer edges of the inter-engaging latches 15,16 are chamfered to provide the necessary camming action. As soon as the latches 15,16 clear the rear face of the corresponding portion of the second clip component they snap into the position illustrated in FIG. 2. Prior to mounting of the jack socket the components can be disassembled by manually easing the latches 15,16 towards each other thereby allowing the latch surfaces to become disengaged by the latches and facilitating removal of the second clip component.

After the first and second clip components have been secured to each other as described above the jack socket 4 is installed by inserting the jack receiving portion 7 into the tubular portion 14 of the first clip component and pressing the jack socket home until the printed circuit board 8 engages under latches 18 provided on resiliently deformable legs 19 of the second clip component. The exterior of the jack receiving portion 7 is a snug fit within the tubular portion 14.

Accordingly, with the jack socket in position as illustrated in FIG. 2 the latches 15,16 are unable to move towards each other and to become disengaged from the latch surfaces of the second clip component. Thus, the components are locked against accidental disassembly. If deliberate disassembly is required the legs 19 are flexed apart to release the latches 18 and permit withdrawal of the printed circuit board 8 and with it the jack receiving portion 7. Thereafter the latches 15,16 can be flexed towards each other to release the second clip component following which the first clip component can be removed by manipulation of the retaining clip 17.

Although the invention has been described with particular reference to a mounting system in which the socket is a jack socket which is mounted on a printed circuit board, the printed circuit board being used to mount the jack socket on the second clip component, it is to be understood that other arrangements are possible within the scope of the present invention. In particular, the socket may be furnished with mounting surfaces specifically for the purpose of securing the socket to the second clip component.

What is claimed is:

1. A socket mounting system comprising a mounting panel having an aperture therein; a first clip component having a face portion which, in use, lies on an obverse side of the mounting panel; a second clip component having a socket clip portion; a socket releasably secured to the second clip component by means of the socket clip portion, the socket having a portion which is presented to the aperture in the mounting panel for receiving a plug inserted from the obverse side of the mounting panel; and inter-engaging latches on the first and second clip components for latching the first clip component to the second clip component, the latches being mutually engageable and disengageable prior to mounting of the socket by the socket clip portion, but being locked against disengagement by the socket when the socket is mounted on the socket clip portion.

2. A socket mounting system according to claim 1 wherein the first clip component includes a portion which extends through the aperture in the mounting panel and the inter-engaging latches are located on the reverse side of the mounting panel.

3. A socket mounting system according to claim 1 wherein the first clip component includes retaining clips which releasably snap fit into retaining engagement with portions of the mounting panel when the first clip component is offered up to the mounting panel.

4. A socket mounting system according to claim 3, wherein the portions of the mounting panel engaged by the retaining clips are surface portions of a reverse side of the mounting panel, openings being provided for the retaining clips to pass through the mounting panel to engage said surface portions.

5. A socket mounting system according to claim 1 wherein the latches are provided by portions of the first clip component located on opposite sides of the aperture which snap fit into engagement with corresponding portions of the second clip component.

* * * * *